United States Patent [19]

McPherson

[11] 4,444,291

[45] Apr. 24, 1984

[54] LADDER ACCESSORY

[76] Inventor: Larry T. McPherson, 5850 Pratt Rd., Lapeer, Mich. 48446

[21] Appl. No.: 432,639

[22] Filed: Oct. 4, 1982

[51] Int. Cl.[3] ..... E06C 7/48

[52] U.S. Cl. ..... 182/214; 182/107; 182/206

[58] Field of Search ..... 182/214, 206, 107, 108

[56] References Cited

U.S. PATENT DOCUMENTS 4,339,020 7/1982 Wiseman ..... 182/214

FOREIGN PATENT DOCUMENTS 2430513 2/1980 France ..... 182/206

26977 of 1910 United Kingdom ..... 182/206

409949 5/1934 United Kingdom ..... 182/214

*Primary Examiner*—R. P. Machado

*Attorney, Agent, or Firm*—Harry R. Dumont

[57] ABSTRACT

A fitting for a ladder including a pair of brackets releasably attached to the ladder legs and including a pair of downwardly directed hook portions and associated parts that are sized to be seated in a gutter. The brackets are connected by a crossbar and in a second mode of operation a non-skid, resilient faced member is attached to the crossbar. Thus the resilient faced member can be used against aluminum siding and the like to distribute the weight and thus avoid damage to the exterior wall of the building.

6 Claims, 3 Drawing Figures

LADDER ACCESSORY

BACKGROUND OF THE INVENTION

The present invention relates to safety and convenience problems related to the use of ladders. A major problem in their use is to provide a secure anchoring of the upper end of the ladder and yet one that can be changed frequently and easily to move it from position to position. One structure found in most dwellings and many other commercial buildings is the eavestrough which is itself well fixed to the dwelling and affords a sound anchoring device for the upper end of the ladder. By use of an appropiately curved periphery portion, it is possible to adapt the accessory to fit in a broad range of sizes of eavestroughs thus to make it useful in many environments.

A second problen frequently encountered with modern dwellings is that of having a relatively fragile exterior wall surface against which the upper ladder must be abutted. This is particularly true where the exterior surface is made up of aluminum siding, vinyl siding, or the like. If the bare ends of the ladder are allowed to abut surfaces, damage to the paint and to the siding can result. Additionally, the surfaces are frequently quite slippery and can introduce an element of danger with regard to slide slippage of the ladder.

The present invention overcomes the above noted problems and is readily changed over between the two modes of operation for eavestrough hooking and/or sidewall placement.

BRIEF DESCRIPTION OF THE PRESENT INVENTION

The present invention thus includes a slideable opposed pair of brackets that are removably attached anywhere along the length of the ladder legs and include hook portions that are curved and capable of fitting into a large number of sizes of eavestroughs yet maintaining a safe angle of the ladder with regard to the horizontal or ground surface. By a simple conversion and attachment of a rigid backed resilient pad, the ladder can be used and abutted against relatively fragile and/or slippery wall surfaces.

BRIEF DESCRIPTION OF THE DRAWINGS

The present invention will now be described with reference to the specification and drawings in which like numerals are used to refer to like elements whenever they may occur among the several views and in which.

DETAILED DESCRIPTION OF THE PREFERRED EMBODIMENT

Figure 1:
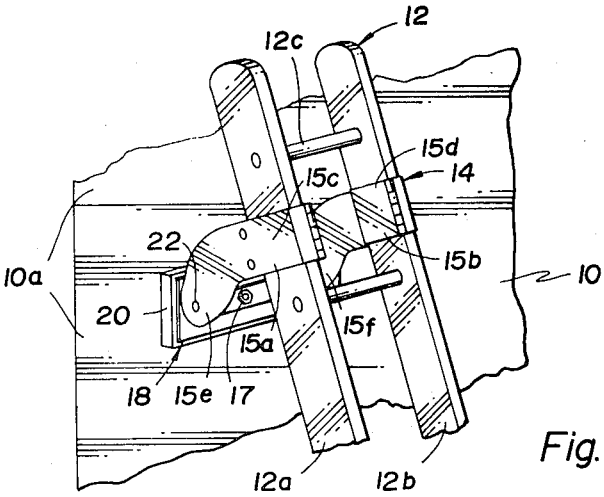
FIG. 1 is a fragmentary, perspective view of a ladder incorporating the device.

FIG. 1 shows a ladder 12 positioned against a flat exterior wall surface 10 that is comprised of a plurality of lap siding members 10*a* that are fabricated of aluminum siding material. It will be understood that this material is easily dented if the pressure exerted by the upper end of the ladder 12 is not distributed over its surface. The ladder 12 includes the legs 12*a* and 12*b* and a plurality of rungs 12*c* as shown. It will be understood that the ladder 12 may be a single or a double ladder in which one is connected to the other and the two are journaled with sliding relative movement to provide selective changes to the overall ladder length. The detail of this arrangement is not shown in the interest of simplicity and brevity.

The ladder accessory is indicated generally by the numeral 14 and includes a pair of brackets 15*a* and 15*b* which are removably attached to the ladder legs for ready attachment and removal. The brackets 15*a* and 15*b* each include a relative hinged portion 15*c* and 15*d* for releasably holding it to the respective ladder leg.

Figure 2:
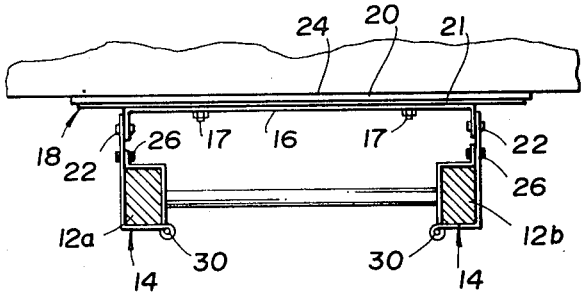
FIG. 2 is a top sectional view with parts removed showing the installation of the device.

The brackets 15*a* and 15*b* further have respective downwardly inclined hook portions 15*e* and 15*f* which have curved peripheries that are sized to be received in eavestroughs over a broad range of sizes. Each hook portion 15*e, f* includes an arcuate cut-out portion 15*g* to provide clearance over the outer eavestrough lip. This particular feature is better shown in FIG. 3. The operation of the ladder accessory in its combined mode is shown in FIG. 1 in which the ladder is mounted for flat wall operation. A resilient faced rigid member 18 is connected across the crossbar 16 as shown by bolt fasteners 17 as best shown in FIG. 2. It is essential that the crossbar 16 be pivotally attached to the respective brackets and this is accomplished through pins 22. It allows the rigid member 18 to pivot and to allow close and solid abuttment between it and the adjacent wall surface 10. A further non-skid facing material 24 such as rubber or a rubberized paint is preferably used on the forward surface of the resilient pad 20 to prevent sideward or other slippage of the ladder accessory against the face of the wall surface 10. FIG. 2 shows the manner in which the brackets 15*a* and 15*b* envelop the respective legs of the ladder 12*a*, 12*b* and are securely attached in place by bolt fasteners 26.

Figure 3:
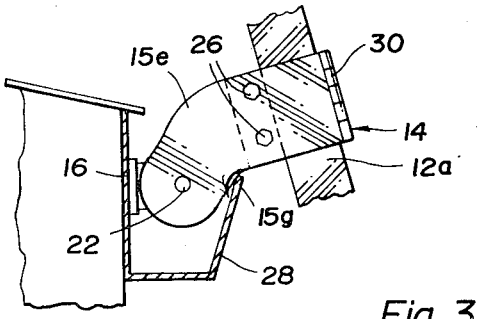
FIG. 3 is a fragmentary view showing the resilient member removed and with the ladder in the eavestrough-mounted position.

FIG. 3 shows the use of the ladder accessory in its gutter attached mode. The rigid member 18 has been taken off by removing the bolt fasteners 17. This permits the downwardly curved peripheries of the hooked portions 15*e, f* to be fitted into the building gutter 28. Even more importantly, the weight of the ladder and the person using it, are distributed throughout the length of the crossbar 16 to prevent the ladder from denting or bending the rain gutter 28. FIGS. 2 and 3 further show the manner in which the ladder accessory is installed on the ladder by opening and closing about the hinges 30 and by fastening and unfastening the fasteners 26 when appropriate.

It will thus be seen that I have provided a substantially improved ladder accessory that permits the use of the ladder on a broad variety of fragile surfaces and in further conjunction with gutters in a manner not possible or known with prior art devices.

I claim:

1. An accessory for a ladder, comprising:

a pair of brackets, each having a means for releasably holding it to one of the ladder legs;

and a downwardly inclined hook portion having a curved periphery adaptable to be received in a building eavestrough;

an arcuate cut-out portion formed in each of said hook portions for clearance from the eavestrough outer edge;

a pivotal crossbar connected between said hooked portions; and a removable rigid member with a resilient facing member removably attached to said crossbar and adapted to abut an adjacent flat wall surface.

2. The combination as set forth in claim 1 wherein said resilient member includes a facing material of the non-skid type.

3. The combination as set forth in claim 1 wherein said brackets are connected to said crossbar in one mode of operation.

4. The combination as set forth in claim 1 wherein said means for holding said brackets to said respective legs comprise a hinged fastener.

5. The combination as set forth in claim 4 in which each of said brackets are attached in place on said respective ladder legs by a bolt fastener.

6. The combination as set forth in claim 1 in which said rigid member and said crossbar are fastened together by a plurality of bolt fasteners.

* * * * *